US005722723A

United States Patent [19]

Riley et al.

[11] Patent Number: 5,722,723

[45] Date of Patent: Mar. 3, 1998

[54] STABILIZING DEVICE FOR SLIPCOVERS

[75] Inventors: Paula Riley, New York; Kenneth V. Stevens, Brooklyn, both of N.Y.

[73] Assignee: Presicent Partners, LP, New York, N.Y.

[21] Appl. No.: 595,235

[22] Filed: Feb. 1, 1996

Related U.S. Application Data

[63] Continuation-in-part of Ser. No. 270,057, Jul. 1, 1994, Pat. No. 5,547,249.

[30] Foreign Application Priority Data

Jan. 8, 1996 [WO] WIPO ..... WO-96/01063

[51] Int. Cl.[6] ..... A44B 21/00

[52] U.S. Cl. ..... 297/228.13; 297/226; 297/229; 24/462

[58] Field of Search ..... 240/460, 462, 240/72.5, 304, DIG. 11, 487; 297/229, 226, 225, 228.13; 49/489.1; 52/716.3, 717.03, 717.05; 160/392, 395

[56] References Cited

U.S. PATENT DOCUMENTS

| | | | |
|---|---|---|---|
| 671,727 | 4/1901 | Hipolito et al. | 160/395 |
| 2,526,376 | 10/1950 | London | 24/462 X |
| 2,601,890 | 7/1952 | Smith | 297/229 |
| 2,776,705 | 1/1957 | Robinson | 297/229 |
| 2,835,325 | 5/1958 | Gilbert et al. | 160/395 X |
| 3,141,221 | 7/1964 | Falulls, Jr. | 24/462 X |
| 3,205,547 | 9/1965 | Riekse | 24/462 |
| 3,612,607 | 10/1971 | Lohr . | |
| 3,991,806 | 11/1976 | Abell | 160/392 X |
| 4,799,299 | 1/1989 | Campbell | 24/462 |
| 5,009,540 | 4/1991 | Nolan | 160/392 X |
| 5,152,034 | 10/1992 | Konings et al. | 24/487 X |
| 5,380,120 | 1/1995 | Vermeulen | 24/462 X |
| 5,547,249 | 8/1996 | Riley et al. | 24/304 X |

FOREIGN PATENT DOCUMENTS

| | | | |
|---|---|---|---|
| 77125 | 12/1961 | France | 24/462 |
| 1950288 | 4/1971 | Germany | 297/226 |
| 3513076 | 10/1986 | Germany | 297/226 |
| 303282 | 1/1929 | United Kingdom | 297/226 |

*Primary Examiner*—James R. Brittain

[57] ABSTRACT

A one-piece elongated member which can be used in combination with a piece of upholstered furniture for stabilizing a slipcover to the furniture, is, or can be formed into a V-shaped structure that has a compressed position for being slid into a flexible crease of the furniture, and an expanded condition for being wedged in the crease. The member is wrapped with a portion of the slipcover. Once the member is wedged into the crease, it securely holds and stabilizes the slipcover in the crease so that it is not removed even with use of the upholstered furniture. The elongated member includes a pair of resilient wings, which are connected to each other at an elongated apex. Each wing has a width between the apex and an outer edge of the wing, which is small in comparison to the length of the member in a direction of elongation.

12 Claims, 6 Drawing Sheets

STABILIZING DEVICE FOR SLIPCOVERS

CROSS REFERENCE TO RELATED APPLICATION

The present application is a continuation-in-part of Ser. No. 08/270,057, filed Jul. 1, 1994 and entitled STABILIZING DEVICE FOR USE WITH COVERS AND CUSHIONS ON SEATING AND UPHOLSTERED FURNITURE. That application is incorporated here by reference now U.S. Pat. No. 5,547,249.

FIELD AND BACKGROUND OF THE INVENTION

The present invention relates, in general, to stabilizing devices for securing fabric slipcovers to furniture, and in particular, to a new and useful stabilizing device in the form of an elongated, resilient member that is, or can be formed into a V-shape for fixing a slipcover to the furniture by a wedging action.

The use of fabric throw covers or slipcovers on upholstered furniture has become very popular in recent years. The covers can vary in size, ranging from, for example, a 100" by 90" cover for chairs, to a 100" by 170" cover for large sofas. Conventionally, after the cover has been loosely placed on the sofa, the user hand tucks the fabric cover into the spaces between the seat cushion and back and between the seat cushion and the arms at each side of the seating perimeter. After a cover has been tucked in place, however, problems quickly arise due to normal use of the furniture. Normal movements of a person sitting on the furniture tend to displace the cover. The appearance of the cover quickly becomes unsightly because it is wrinkled, bunched up and out of place. Accordingly, to maintain the proper and desired position for the cover, the user must continuously adjust, smooth and retuck the cover. U.S. Pat. No. 517,306 discloses a device for fastening slipcovers to upholstered furniture. The device includes several narrow, clip-like fasteners with teeth that penetrate the slipcover. This device will damage, and eventually destroy the slipcover. The device is also difficult to remove once in place because each clip must be individually compressed and disengaged from the cushions and the slipcover, and then all of the compressed clips much be removed simultaneously. Other problems with this device are that the fastener can easily be moved out of position, if the slipcover is moved laterally, and multiple fasteners must be used.

U.S. Pat. No. 2,776,705 discloses a spring-loaded fabric holder which utilizes a pair of springs which spread a pair of bars for wedging a slipcover in the crease between the back and seat of a piece of upholstered furniture. This reference has the drawback of complex design and further exposes the fabric surfaces to the spring steel springs which may damage the fabric. The slipcover may also be dislodged by pulling the spring from the crease, in that pulling on the slipcover tends to compress the spring and remove it from the crease rather than causing the spring to tighten its hold on the slipcover. See U.S. Pat. No. 2,601,890 for another spring device for holding a seat cover.

U.S. Pat. No. 5,380,120 discloses a profiled, V-shaped snap-in clip which is partially wrapped in a piece of foil and then snapped into a correspondingly shaped, rigid profiled frame. This patent does not deal with furniture.

British Patent Specification 303,282, dated Jan. 3, 1929, discloses a cylindrical member for holding a slipcover onto a seat by pressing the cylindrical member against the slipcover and into the crevice between the seating area and back area of the furniture. The inventors of the present application have experience with this structure and have found that it cannot securely prevent the slipcover with cylinder from being pulled from the crevice.

A need remains for a simple, economical yet effective stabilizing device for securely holding a slipcover to a piece of upholstered furniture.

SUMMARY OF THE INVENTION

An object of the present invention is to provide a stabilizing device that securely holds a slipcover to be initially tucked into place in a crevice of upholstered furniture and in a desired position, and thereafter prevents its relative movement with respect to the upholstered furniture during normal use, while simultaneously preventing damage to the slipcover. It is a further object of the invention to form the stabilizing device of an elongated, single piece of resilient material which can advantageously be extruded of plastic in a very efficient and economical manner. The stabilizing device has a length to hold the slipcover uniformly along the fabric so that there is a reduced tendency to tear or deform the fabric, and in a way that avoids removal of the tucked fabric from the crevice or crease.

In accordance with the present invention, the stabilizing device is an elongated member having a pair of arms forming, or formable, into a V-shape. The member is preferably made of an elastic resilient material so that the pair of arms are collapsible from a first naturally open stable position to a second unstable closed position, without undue force. When the V-shaped device is pressed into the crevice and into a portion of slipcover that has been tucked into the crevice, the arms of the device open and wedge the tucked fabric so that it cannot easily be removed from the crevice.

A further object of the present invention is to provide a stabilizing device which is simple in design, rugged in design and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
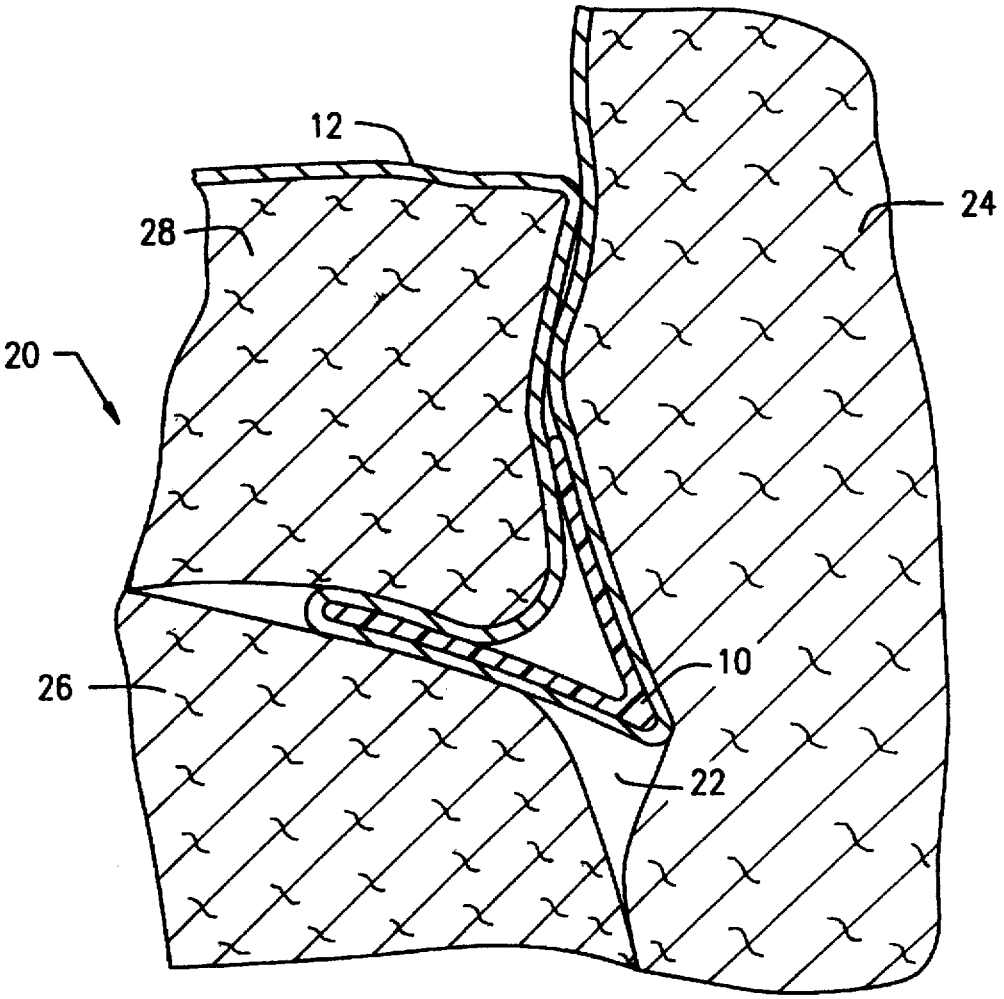
FIG. 1 is a sectional view of the stabilizing device of the present invention shown lodged in the crease of a piece of upholstered furniture in accordance with the present invention.
Figure 2:
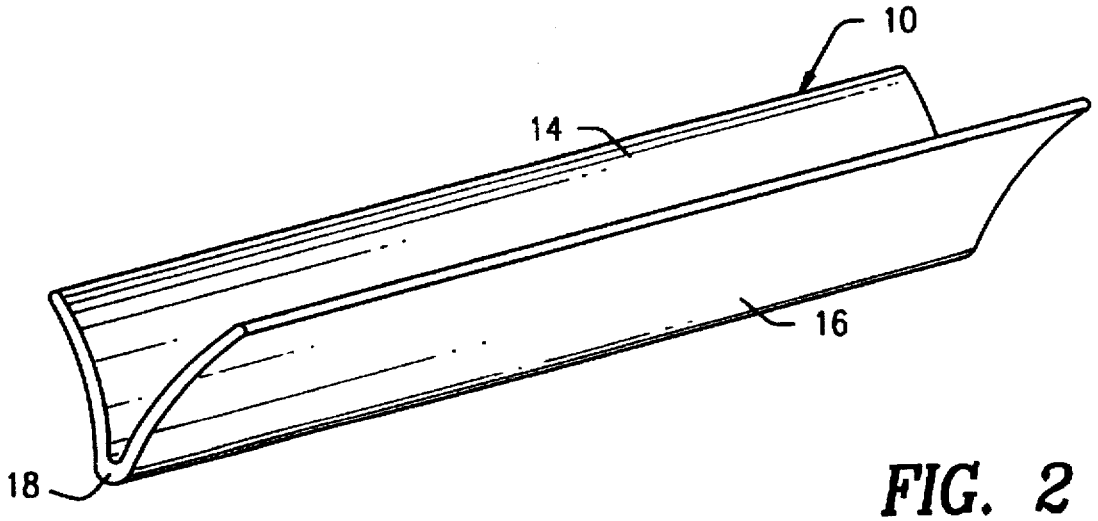
FIG. 2 is a perspective view of the stabilizing device of FIG. 1.

Referring to the drawings, in particular, the invention embodied in FIGS. 1 and 2, comprises a one-piece elongated member generally designated 10, made of resilient material such as elastomer, for example polyvinylchloride (PVC), thermoplastic or thermosetting rubber or polystyrene. This is not meant to be an exhaustive list of materials. The one-piece material is advantageously provided with a shore durometer hardness of 45–105, with an even more preferred range of 50 to 90.

The invention is used in combination with a fabric slipcover 12 and a piece of upholstered furniture generally designated 20 which includes an elongated crevice or crease 22, defined between unstructured and flexible walls of the furniture, such as a soft upholstered back 24, under-seat 26 and seat cushion 28. The direction of elongation is perpendicular to the plane of FIG. 1. In accordance with the invention, flexible walls which bound the crease need not include the elements shown, but may be any other flexible wall structure that is upholstered.

The elongated member 10 includes a pair of resilient wings 14 and 16, which are connected to each other at an elongated apex 18. Each wing has a width between the apex and an outer edge of the wing, which is small in comparison to the length of the member in a direction of elongation.

Due to the resilient flexibility of the wings 14 and 16, the member has a compressed position (see the phantom line positioning of FIG. 4) with the wings pressed toward each other for insertion of the member downwardly into the crease. The member also has an expanded position of the wings, which resiliently expand in the crease, as shown in FIG. 1. Although FIG. 1 shows the V-shaped member in its expanded position, engaged around a corner of the flexible cushion 28, other wedging action is possible due to the flexibility of the crease and the outward biasing of the V-shaped member. This tends to wedge the member in the crease.

By wrapping a portion of the slipcover around the elongated member 10, and wedging it into the crease as shown in FIG. 1, the slipcover is held in a stable secure position in the crease, despite the fact that users of the furniture will sit on the cushion and move around on the furniture. Rather than withdrawing the slipcover portion from the crease, such movement only tends to more securely wedge the member in the crease, and thus securely hold the portion of slipcover wrapped around the member in the crease.

In the embodiments of FIGS. 1–6, each one-piece member includes an apex 18 having a preformed shape to achieve the V-shape of the member. In the embodiments of FIGS. 1–6, each wing is curved inwardly toward the other wing from the apex toward the outer edge of the wing. For convenience, the same reference numerals are utilized to designate the same or functionally similar parts in the embodiments of FIGS. 1–6.

Figure 3:
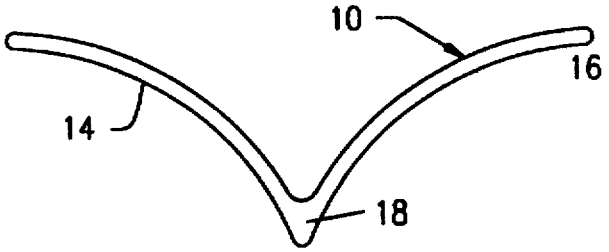
FIGS. 3–11 are end views of nine additional embodiments of the invention.
Figure 4:
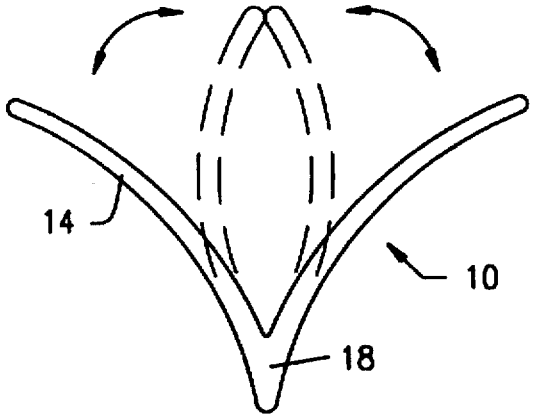
Figure 5:
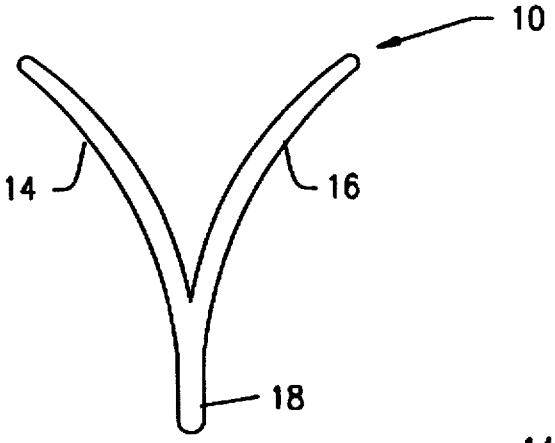
Figure 6:
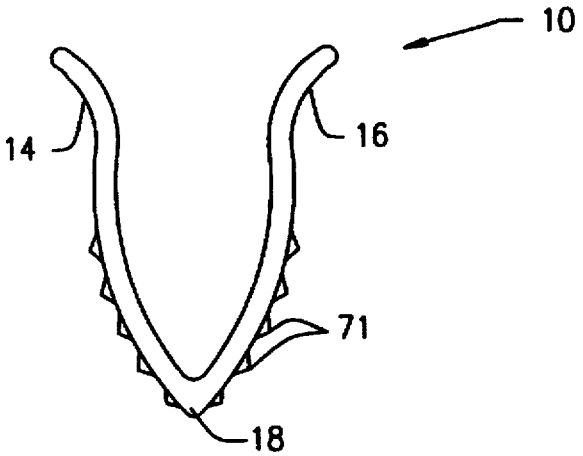

In the embodiment of FIGS. 3 and 6, the apex 18 includes a slight additional accumulation of material, but is not much thicker than the wings themselves. In the embodiment of FIGS. 4 and 5, however, the apex 18 includes a widened dimension extending away from the wings. This further enhances the pointed base of the V-shape, which increases it's ability to be inserted and pushed deep into the crease between the flexible walls of the upholstered furniture.

Figure 7:
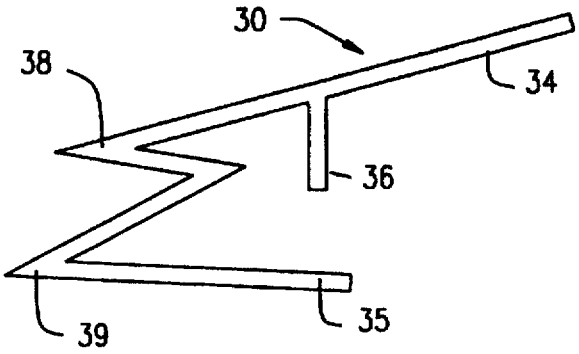

FIG. 7 illustrates a further embodiment of the one-piece member, generally designated 30, having a double apex 38, 39 and an elongated stop 36, which extends approximately normally from one of the wings 34, which is longer than the other wing 35. The double apex 38, 39 produces a bellows effect, for enhancing the movement of the member between its resiliently compressed position and its resiliently expanded position (the expanded position is shown in FIG. 7) and also maintains a minimal spacing between the wings 34 and 35, even in the compressed position by virtue of the fact that the stop portion 36 stops further movement of the wings toward each other. Use of one wing 34, which is longer than the other wing 35, is also useful if the flexible crease of the furniture is particularly flexible, for example, if the crease is bounded by a very soft cushion. The longer wing 34 will wedge under the softer cushion, increasing the wedging effect and reducing the tendency of the slipcover to be pulled from the crease.

Figure 8:
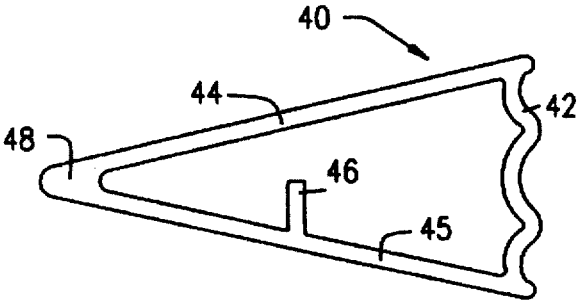

FIG. 8 shows a further embodiment of the one-piece resilient member generally designated 40, having a pair of wings 44 and 45 with a stop 46 connected to one of the wings, a single apex 48, and a further element, namely a compressible connector 42, for example, a bellows-shaped connector, which connects the outer edges of the wings 44, 45 to each other. This compressible connector allows the member 40 to be collapsed to its compressed position, but enhances the expansion of the member into its expanded position.

Figure 9:
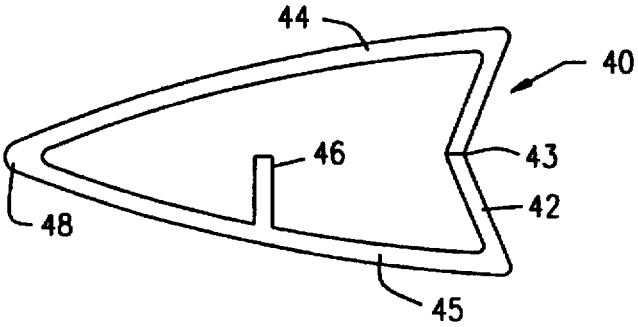

Another version of this concept is shown in FIG. 9, where the connector includes a single bend, or elbow 43. The same reference numerals are used, as those used FIG. 8, to designate functionally similar parts.

Figure 10:
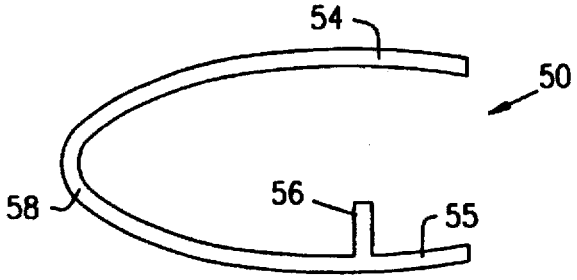

FIG. 10 illustrates a still further embodiment of the member generally designated 50, having wings 54 and 55, one of which carries an elongated stop portion 56. The apex of the member in FIG. 10 is a smoothly rounded bend 58, but still the generally V-shaped configuration is maintained to advance the purpose of the invention, namely to allow the member to be compressed for insertion into the flexible crease, but then resiliently expand for wedging itself into the crease.

Figure 11:
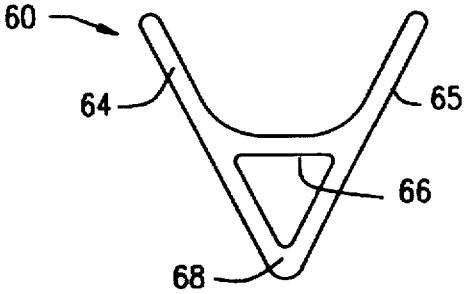

FIG. 11 shows another embodiment generally designated 60, where the wings 64 and 65 are connected to each other by a web 66, which is spaced from the apex 68, and from the outer edges of the wings.

The embodiments of FIGS. 1–11 all utilize a preformed apex so that the one-piece elongated member always has a substantially V-shaped configuration.

The embodiments of FIGS. 12–23 differ from the embodiments of FIGS. 1–11 in that a so-called "live" hinge is utilized to form the apex. As is known in the field of elastomers, a live hinge can be formed by simply crimping or reducing the thickness of the elastomeric material along a straight line. The material, because of its inherent flexibility, elasticity and resilient characteristics, can be bent along the live hinge a multiplicity of times, without breaking. A great advantage of a live hinge is that it can be manufactured in one step as the member is being manufactured, for example, by extrusion, yet it achieves a functional hinge without any other mechanical parts.

Figure 12:
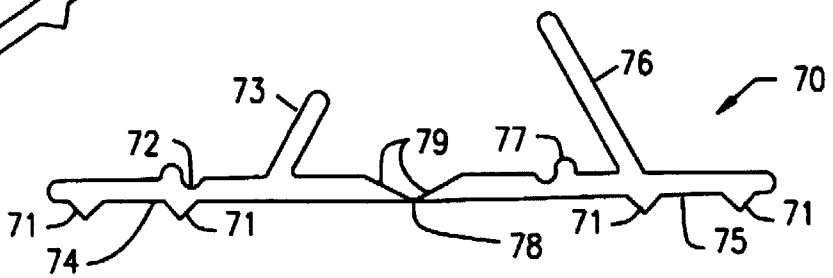
FIG. 12 is an end view of a further embodiment of the invention in an open position, immediately after manufacture and also in a position for storage, shipping and sales.
Figure 13:
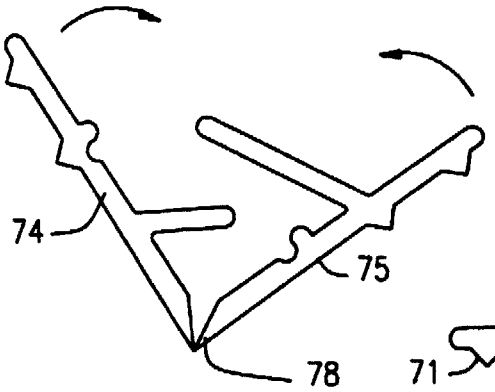
FIG. 13 is an end view of the embodiment of FIG. 12 shown in an intermediate position.
Figure 14:
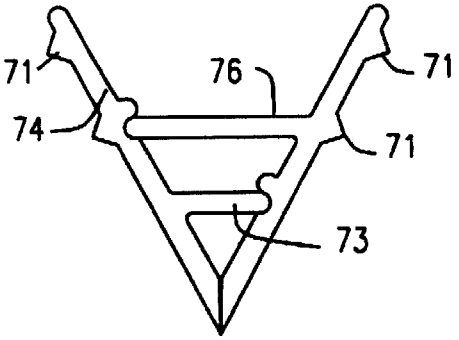
FIG. 14 is an end view of the embodiment of FIG. 12 shown in a use position.
Figure 17:
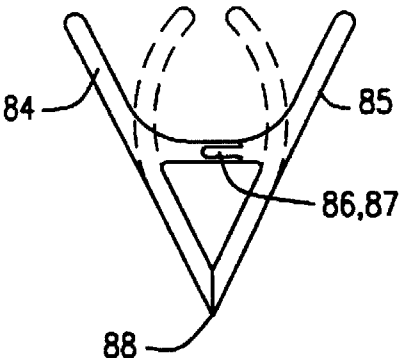

As shown in FIG. 12, the elongated member generally designated 70 can be extruded as a substantially flat element having various projections. At a location between wing portions 74 and 75 which will ultimately form the wings of the member, a reduced thickness area 78 is provided, which will form the live hinge as shown in FIGS. 13 and 14. The live hinge can also be shaped, for example, to have a V configuration, so that the bevelled surfaces of the live hinge will mate with each other to further fix the V-shape, as shown in FIG. 14. The bevelled surfaces are labelled 79 in FIG. 12.

In the embodiment of FIG. 12, one of the wings 74 includes a relatively short stop portion of projection 73, while the other as a relatively long stop portion of projection 76. Both are elongated in the elongated direction of the member, but the short stop portion is spaced closer to the apex 78 than the long stop portion. In addition, wing 74 includes an elongated recess 72, on the inner surface and a pair of projections 71, 71, one of which is opposite the recess 72. The other wing 75, also have projections 71, 71, one of which is opposite the long stop portion 76. An inner surface of wing 75 also includes a recess 77.

The purpose of the projections 71 is both to provide additional material to reinforce either the stop portions or the recesses, and also to help better bite into the flexible crease walls of the furniture.

FIG. 13 shows an intermediate position as the member is closing toward its use position, which use position is shown in FIG. 14. The use position corresponds to the resiliently expanded position and in this position the stop portions 73, 76 engaged into the respective recesses 72, 77 to reinforce the expanded position. The compressed position is achieved by forcing the wings, under the resiliency of the material of the member, toward each other. An example of this compressed position is shown in the phantom lines of FIG. 17, in connection with another embodiment of the invention.

Figure 15:
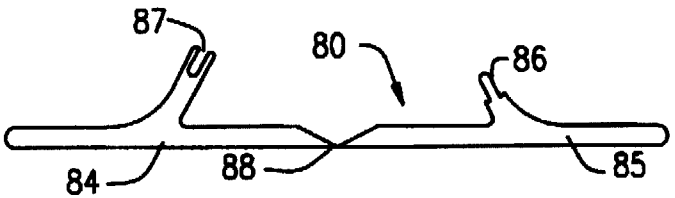
FIGS. 15, 16 and 17 are views which are similar to FIGS. 12, 13, and 14, respectively, but showing a further embodiment of the invention.
Figure 16:
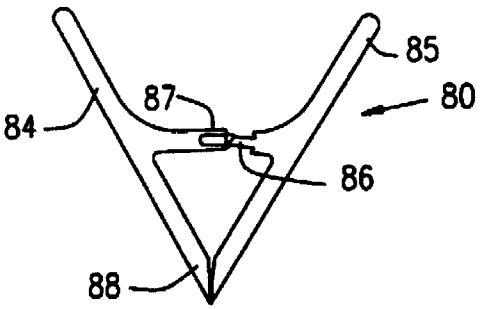

FIG. 15 shows another embodiment of the invention generally designated 80 having a live hinge 88 between a pair of resilient wings 84, 85. As with the embodiment of FIG. 12, bevelled surfaces are utilized to form the apex or hinge 88. In the embodiment of FIG. 15, an elongated stop projection 86 is formed on the inner surface of wing 85 and an elongated stop recess 87 is formed on the other wing 84. FIG. 16 shows an intermediate position while the wings are being folded about the live hinge 88, and FIG. 17, in solid line, shows the use position of the member where the projection 86 is snapped into and held in the stop recess 87. The advantage of this embodiment is that once the V-shaped use position is achieved, it will be maintained by the snap connection between the projection 86 and the recess 87. This also illustrates another advantage of the embodiments of FIGS. 12–23, mainly that it can be manufactured, transported, sold and brought home in a flat position which is easy for storage but then bent into the use position.

Figure 18:
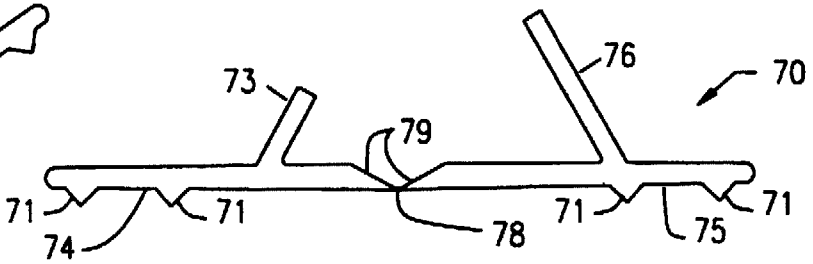
FIGS. 18, 19 and 20 are views similar to FIGS. 12, 13 and 14, but showing a still further embodiment of the invention.
Figure 19:
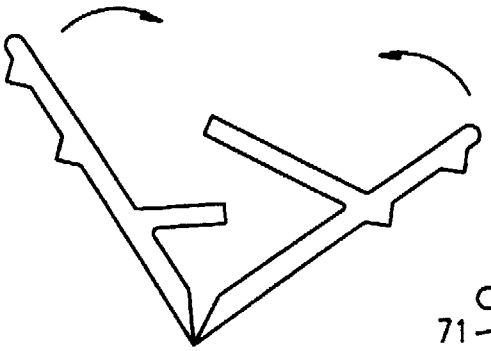
Figure 20:
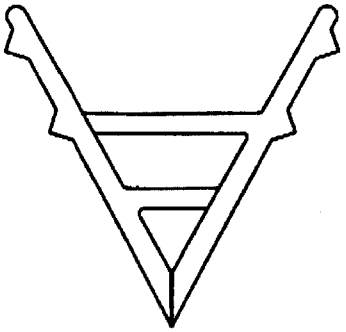

FIGS. 18, 19 and 20 show a further embodiment of the invention which is similar to the embodiment of FIGS. 12–14 but without the recesses. Accordingly, the same reference numerals are utilized to identify functional similar parts to those in FIGS. 12–14.

Figure 22:
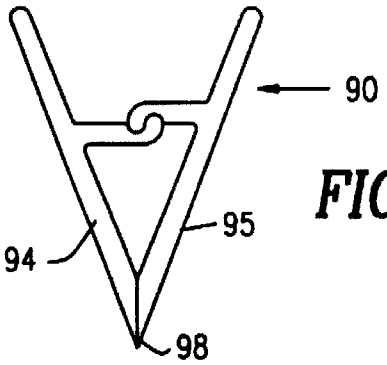
FIG. 22 is an end view of the embodiment of FIG. 21 shown in a closed use position.
Figure 21:
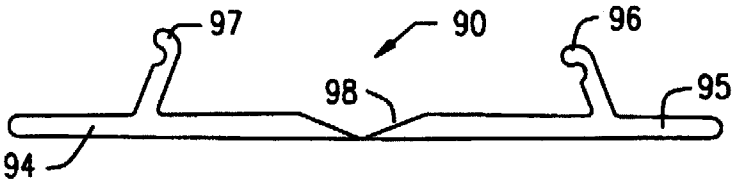
FIG. 21 is a view similar to FIG. 12 of yet a further embodiment of the invention.

The embodiments of FIGS. 21 and 22 comprise an elongated one-piece resilient member generally designated 90 having a pair of wings 94, 95 connected to each other by a live hinge 98. Each of the wings includes an elongated stop hook 96, 97 with a pair of hooked ends which hook in the same direction and are placed along the width of the wings so that in the use position of FIG. 22, the stop hooks engage each other and are resiliently held to each other to maintain the V-shape.

Figure 23:
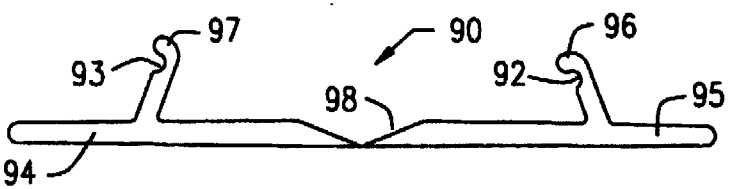
FIG. 23 is a view similar to FIG. 21 of a further embodiment of the invention.

FIG. 23 shows another embodiment which is similar to that of FIG. 21, but with thicker stop hooks 96, 97 which create the hook configuration by being formed with slight recesses 92 and 93. Each recess is shaped to engage the enlarged head of the other stop hook, again to hold the use position similar to that shown in FIG. 22. In the embodiment of FIG. 23, the same reference numerals are used to identify the same or functionally similar parts.

Figure 24:
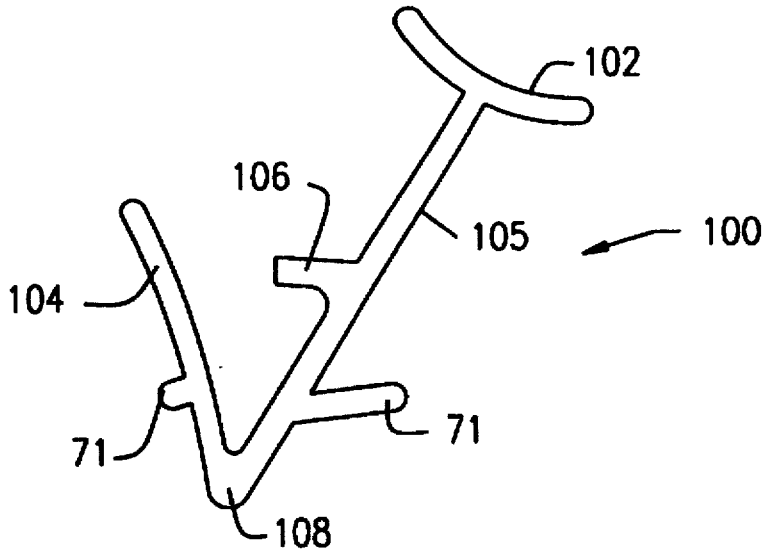
FIG. 24 is a view similar to FIG. 13 of a further embodiment of the invention.

FIG. 24 illustrates a further embodiment of the elongated member generally designated 100, with an apex 108 that may be a preformed apex as in the embodiment of FIG. 2, or a "live" hinge as in the embodiment of FIG. 12. Since the apex 108 has a thin wall, a stop projection 106 extends from the inner surface of one of the wings 104, so that in the use position, the V-shape is set when the stop 106 engages against the inner surface of the other wing 105. The stop portions in the other embodiments that use stop portions, have a similar function, especially where a live hinge is used so that without the stop, the wings would move too close to each other in the use position.

The embodiment of FIG. 24 also has another feature, namely an integrated thumb push 102, connected to and extending normal to the outer edge of wing 105. Thumb push 102 extends the full elongated length of the member (which is perpendicular to the plane of FIG. 24), and forms a push surface than can be used to push the member into the furniture crease, without tools. The invention includes any other shape for the push surface and a push surface can be added to any of the other embodiments of the invention. In the crease, the push surface actually increases the wedging action that retains the member, and slipcover portion wrapped therearound, in the cease.

Figure 25:
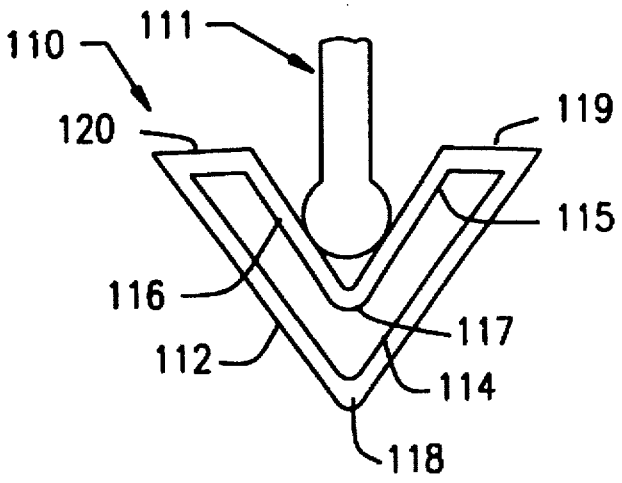
FIG. 25 is a view similar to FIG. 4 of a still further embodiment of the invention.

The elongated member 110 shown in FIG. 25 is a hollow one piece member with inner and outer preformed apexes 117 and 118, formed between inner and outer wing pairs 115, 116 and 112, 114. The outer edges of the wing pairs are connected by connector portions 119, 120. A push tool 111 is used to push the member 110 into the crease of the furniture. The double wall construction is used to enhance the resiliency of the member to maintain its expanded use position, despite the thin walls of the apexes.

While the specific embodiments of the invention have been shown and described in detail to illustrate the application of the principles of the invention, it will be understood that the invention may be embodied otherwise without departing from such principles.

What is claimed is:

1. A combination with a piece of upholstered furniture, for stabilizing a slipcover to the furniture, comprising:

a piece of upholstered furniture having an elongated crease defined between unstructured and flexible walls;

a one-piece elongated member made of resilient material and having a pair of resilient wings connected to each other at an elongated apex, each wing having a width between the apex and an outer edge of the wing which is small compared to a length of the member in a direction of elongation of the member, the member having a compressed position with the wings pressed toward each other for insertion into the crease, and an expanded position with the wings resiliently expanded in the crease, said apex comprising a live hinge between the wings for bending to form the apex and for moving the wings into a V-shaped configuration corresponding to the expanded position;

a stop projection extending from an inner surface of one of the wings toward the other of the wings for engaging the other wing for setting a spacing between the wings corresponding to the expanded position; and a slipcover having a portion wrapped around the member in the crease, the expanded position of the member retaining the member and wrapped portion of the slipcover in the crease by resiliently wedging the wings against the unstructured walls in the crease.

2. A combination according to claim 1, wherein each of the wings have outer surfaces facing away from each other and inner surfaces facing toward each other in the expanded position, each wing having at least one elongated projection on its outer surface.

3. A combination according to claim 1, wherein the stop projection formed on the inner surface of one of the wings for engaging the other wing is elongated in the expanded position of the member.

4. A combination according to claim 3, wherein one of the wings includes a recess for receiving the stop projection.

5. A combination according to claim 4, including a second elongated stop projection on an inner surface of the other wing for engaging said first mentioned elongated stop projection, said second elongated stop projection containing said recess for receiving a portion of the first mentioned stop projection to lock the one-piece elongated member into said expanded position.

6. A combination according to claim 3, wherein one of the wings includes a relatively short stop projection and the other wing includes a relatively long stop projection, the short stop projection being spaced by a smaller amount from the apex than the long stop projection.

7. A combination according to claim 1, including a stop recess in the inner surface of the other wing for receiving the stop projection to maintain the expanded position.

8. A stabilizing device for a piece of upholstered furniture, for stabilizing a slipcover to the furniture, the piece of upholstered furniture having an elongated crease defined between unstructured and flexible walls, the device comprising:

a one-piece elongated member made of resilient material and having a pair of resilient wings connected to each other at an elongated apex, each wing having a width between the apex and an outer edge of the wing which is small compared to a length of the member in a direction of elongation of the member, the member having a compressed position with the wings pressed toward each other for insertion into the crease, and an expanded position with the wings resiliently expanded in the cease so that with a portion of the slipcover wrapped around the member in the crease, the expanded position of the member retaining the member and wrapped portion of the slipcover in the crease by resiliently wedging the wings against the unstructured walls in the crease, the elongated member having a stop portion extending from an inner surface of one of the wings, toward the other of the wings for setting a spacing between the wings corresponding to the expanded position, said apex comprising a live hinge between the wings for bending to form the apex and move the wings into a V-shaped configuration; each of the wings having outer surfaces facing away from each other and inner surfaces facing toward each other in the expanded position, each wing having at least one elongated projection on its outer surface.

9. A stabilizing device for a piece of upholstered furniture, for stabilizing a slipcover to the furniture, the piece of upholstered furniture having an elongated crease defined between unstructured and flexible walls, the device comprising:

a one-piece elongated member made of resilient material and having a pair of resilient wings connected to each other at an elongated apex, each wing having a width between the apex and an outer edge of the wing which is small compared to a length of the member in a direction of elongation of the member, the member having a compressed position with the wings pressed toward each other for insertion into the crease, and an expanded position with the wings resiliently expanded in the cease so that with a portion of the slipcover wrapped around the member in the crease, the elongated member having a stop portion extending from an inner surface of one of the wings, toward the other of the wings for setting a spacing between the wings corresponding to the expanded position, said apex comprising a live hinge between the wings for bending to form the apex and move the wings into a V-shaped configuration; the stop projection formed on the inner surface of one of the wings being elongated for engaging the other wing in the expanded position of the member; one of the wings including a recess for receiving the stop projection.

10. A device according to claim 9, including a second elongated stop projection on an inner surface of the other wing for engaging said first mentioned elongated stop projection, said second elongated stop projection containing said recess for receiving a portion of the first mentioned stop projection to lock the one-piece elongated member into said expanded position.

11. A stabilizing device for a piece of upholstered furniture, for stabilizing a slipcover to the furniture, the piece of upholstered furniture having an elongated crease defined between unstructured and flexible walls, the device comprising:

a one-piece elongated member made of resilient material and having a pair of resilient wings connected to each other at an elongated apex, each wing having a width between the apex and an outer edge of the wing which is small compared to a length of the member in a direction of elongation of the member, the member having a compressed position with the wings pressed toward each other for insertion into the crease, and an expanded position with the wings resiliently expanded in the cease so that with a portion of the slipcover wrapped around the member in the crease, the expanded position of the member retaining the member and wrapped portion of the slipcover in the crease by resiliently wedging the wings against the unstructured walls in the crease, the elongated member having a stop projection extending from an inner surface of one of the wings, toward the other of the wings for setting a spacing between the wings corresponding to the expanded position, said apex comprising a live hinge between the wings for bending to form the apex and move the wings into a V-shaped configuration; the stop projection formed on the inner surface of one of the wings being elongated for engaging the other wing in the expanded position of the member; one of the wings including a relatively short stop projection and the other wing including a relatively long stop projection, the short stop projection being spaced by a smaller amount from the apex than the long stop projection.

12. A stabilizing device for a piece of upholstered furniture, for stabilizing a slipcover to the furniture, the piece of upholstered furniture having an elongated crease defined between unstructured and flexible walls, the device comprising:

a one-piece elongated member made of resilient material and having a pair of resilient wings connected to each other at an elongated apex, each wing having a width between the apex and an outer edge of the wing which is small compared to a length of the member in a direction of elongation of the member, the member having a compressed position with the wings pressed toward each other for insertion into the crease, and an expanded position with the wings resiliently expanded in the cease so that with a portion of the slipcover wrapped around the member in the crease, the expanded position of the member retaining the member and wrapped portion of the slipcover in the crease by resiliently wedging the wings against the unstructured walls in the crease, the elongated member having a stop projection extending from an inner surface of one of the wings, toward the other of the wings for setting a space between the wings corresponding to the expanded position, said apex comprising a live hinge between the wings for bending to form the apex and move the wings into a V-shaped configuration; and a stop recess in the inner surface of the other wing for receiving the stop projection to maintain the expanded position.

* * * * *